US012359890B2

(12) United States Patent
Hoffer et al.

(10) Patent No.: US 12,359,890 B2
(45) Date of Patent: Jul. 15, 2025

(54) FIREARM HOLSTER WITH BACKSIDE TENSIONING

(71) Applicant: Adaptive Tactical LLC, Nampa, ID (US)

(72) Inventors: Nickolas Cody Hoffer, Meridian, ID (US); James K. Bentley, Eagle, ID (US)

(73) Assignee: ADAPTIVE TACTICAL LLC, Nampa, ID (US)

( * ) Notice: Subject to any disclaimer, the term of this patent is extended or adjusted under 35 U.S.C. 154(b) by 0 days.

(21) Appl. No.: 18/586,923

(22) Filed: Feb. 26, 2024

(65) Prior Publication Data

US 2024/0288246 A1 Aug. 29, 2024

Related U.S. Application Data

(60) Provisional application No. 63/487,045, filed on Feb. 27, 2023.

(51) Int. Cl.
*F41C 33/02* (2006.01)

(52) U.S. Cl.
CPC ..... *F41C 33/0236* (2013.01)

(58) Field of Classification Search
CPC ..... F41C 33/0209; F41C 33/0263; F41C 33/041; F41C 33/048; F41C 33/0227; F41C 33/0236
See application file for complete search history.

(56) References Cited

U.S. PATENT DOCUMENTS

| | | | | |
|---|---|---|---|---|
| 9,696,113 | B2 * | 7/2017 | Tedder | F41C 33/0263 |
| 9,702,659 | B2 * | 7/2017 | Bowman | F41C 33/0209 |
| 10,295,305 | B2 * | 5/2019 | Tedder | F41C 33/041 |
| 11,441,871 | B1 * | 9/2022 | Weber | F41C 33/048 |
| 2015/0034683 | A1 * | 2/2015 | Tedder | F41C 33/041 224/242 |
| 2015/0267994 | A1 * | 9/2015 | Tedder | F41C 33/0227 224/242 |

* cited by examiner

*Primary Examiner* — Corey N Skurdal
(74) *Attorney, Agent, or Firm* — Parsons Behle & Latimer

(57) ABSTRACT

A firearm holster that includes a back pad having front and back sides. The firearm holster includes a rigid front plate connected to the front side of the back pad. The front side of the back pad and the rigid front plate define a pocket. The firearm holster includes a first tensioning mechanism connected to the back side of the back pad. The first tensioning mechanism is configured to vary tension applied to a firearm within the pocket. The firearm holster may include a second tensioning mechanism connected to the back side of the back pad. The second tensioning mechanism is configured to vary tension applied to the firearm within the pocket. The orientation of the tensioning mechanisms may be varied to vary the tension applied to a firearm positioned within the pocket of the holster. One or more compressible washers may be used to vary the tension.

18 Claims, 5 Drawing Sheets

SECTION A-A

FIREARM HOLSTER WITH BACKSIDE TENSIONING

FIELD OF THE DISCLOSURE

This disclosure is generally directed to a firearm holster that includes one or more backside tensioning mechanisms. The backside tensioning mechanism may be used to adapt the holster to particular firearms.

BACKGROUND

A firearm holster may be configured to hold multiple firearms or be a universal holster. While a holster may be a universal holster or be configured to hold multiple different models of firearms, the fit of each different model of firearm may not be optimized. For example, a firearm may have a loose fit and not be secured within the universal holster than desired. Other disadvantages may exist.

SUMMARY

In an example, a firearm holster includes one or more backside tensioning mechanisms. The backside tensioning mechanism may be used to adapt the holster to particular firearms.

An embodiment of the disclosure is a firearm holster that includes a back pad having a front side and a back side. The firearm holster includes a rigid front plate connected to the front side of the back pad. The front side of the back pad and the rigid front plate define a pocket. The firearm holster includes a first tensioning mechanism connected to the back side of the back pad. The first tensioning mechanism is configured to vary tension applied to a firearm within the pocket.

The firearm holster may include a second tensioning mechanism connected to the back side of the back pad. The second tensioning mechanism is configured to vary tension applied to the firearm within the pocket. The first tensioning mechanism may be a first plate. The first plate may include a first end, a second end, a first leg, a second leg, a first surface, a second surface, and an aperture through the first plate. The first plate may include a recessed shoulder adjacent to the aperture. A geometry of the first leg may differ from a geometry of the second leg. The tension applied by the first plate may be varied by changing the orientation of the first plate.

The second tensioning member may be a second plate. The second plate may include a first end, a second end, a first edge, a second edge, a first surface, a second surface, and two apertures through the second plate. The second plate may include a recessed shoulder adjacent to the two apertures. The second plate may include a leg. The tension applied by the first plate may be varied by changing the orientation of the first plate.

The firearm holster may include one or more fasteners that connect the first plate to the back pad and the rigid front plate. The firearm holster may include one or more fasteners that connect the second plate to the back pad and the rigid front plate. The firearm holster may include one or more compressible washers positioned between the back pad and the first plate or the second plate.

While the disclosure is susceptible to various modifications and alternative forms, specific examples have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure.

Figure 1:
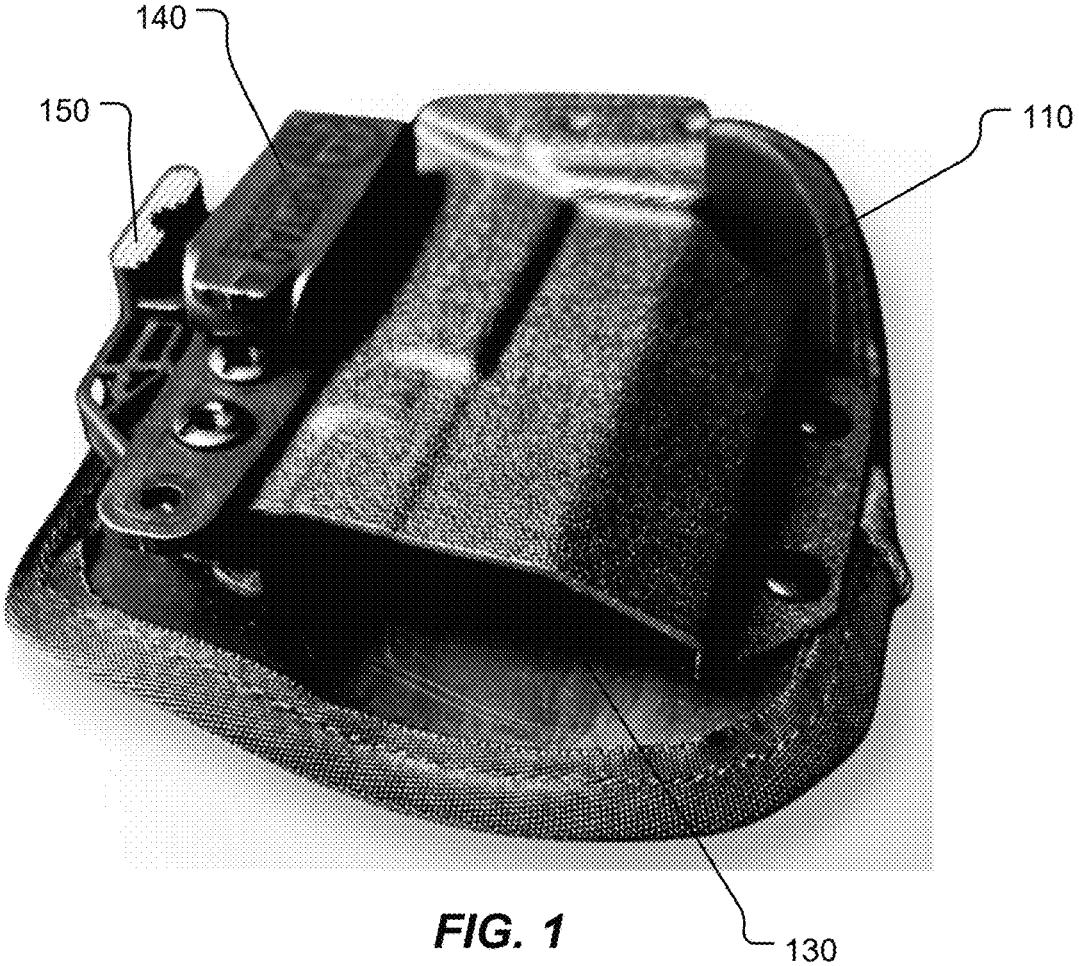
FIG. 1 is a perspective top view of an embodiment of a firearm holster with one or more backside tensioning mechanisms.

While the disclosure is susceptible to various modifications and alternative forms, specific examples have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure

DETAILED DESCRIPTION

Figure 2:
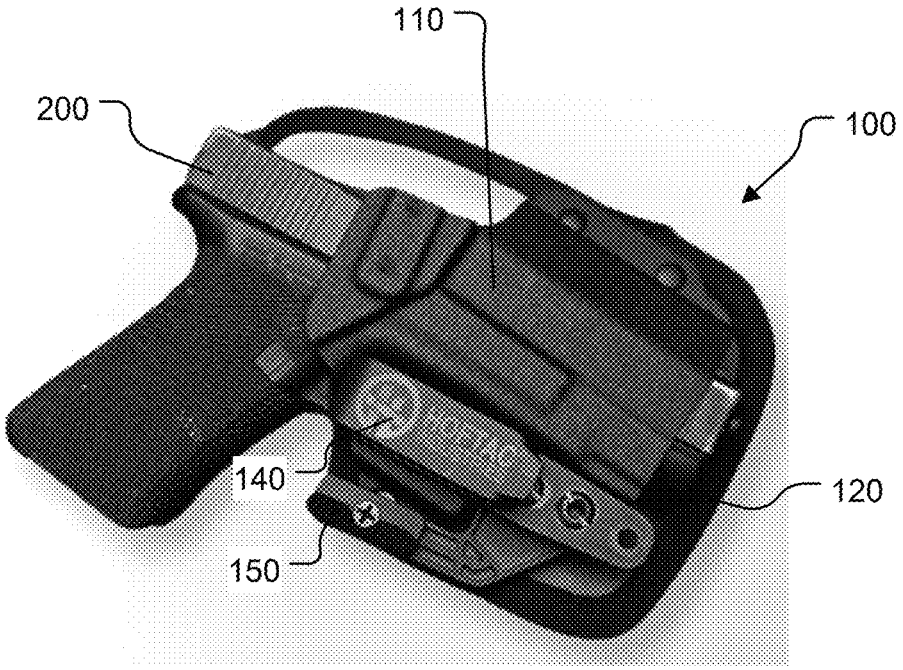
FIG. 2 shows a firearm positioned within an embodiment of a firearm holster.

FIG. 1 shows a firearm holster 100 that may be used with various models of firearms that includes one or more tensioning mechanisms on the backside of the holster 100 to customize the fit of the holster 100 for a particular firearm. The holster 100 includes a rigid front plate 110 connected to a back pad 120. The rigid front plate 110 and the front side 121 of the back pad 120 define a pocket 130 into which a firearm 200 may be inserted as shown in FIG. 2. The holster 100 includes a belt attachment 140 as well as a belt standoff 150.

Figure 3:
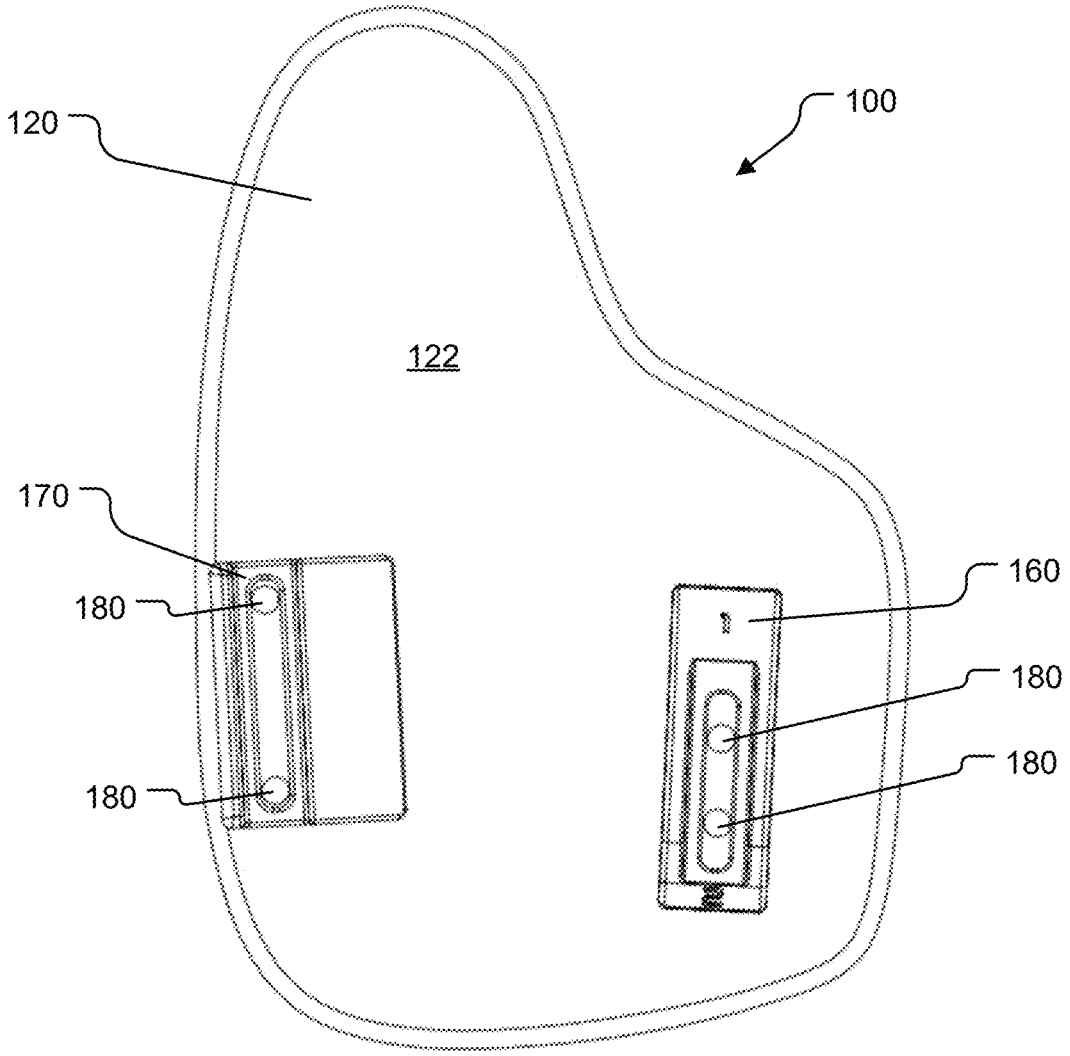
FIG. 3 is back view of an embodiment of a firearm holster having two backside tensioning mechanisms.
Figure 4:
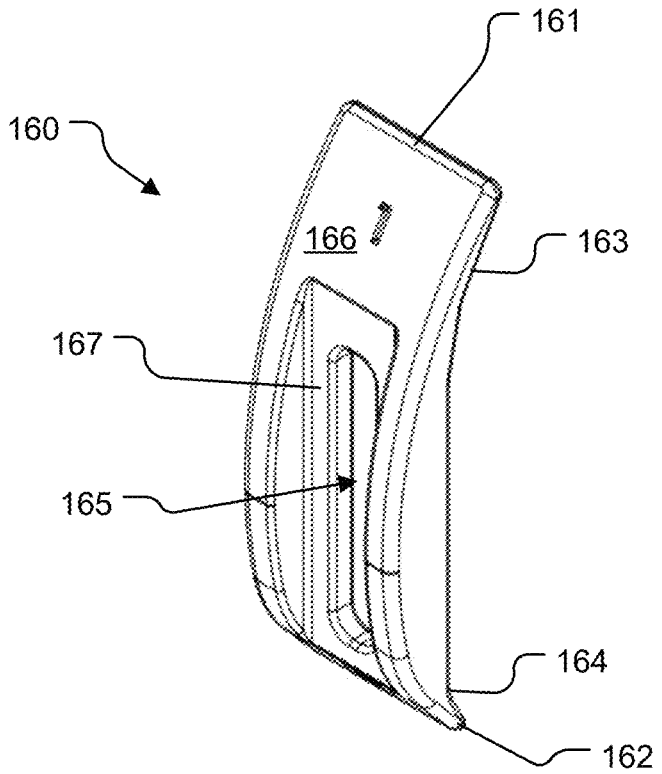
FIG. 4 is a perspective view of an embodiment of a tensioning mechanism.
Figure 5:
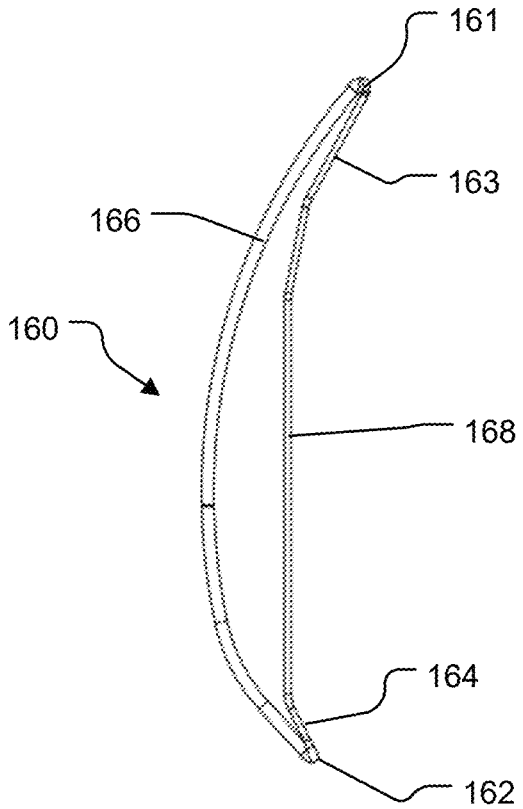
FIG. 5 is a side view of an embodiment of a tensioning mechanism.
Figure 6:
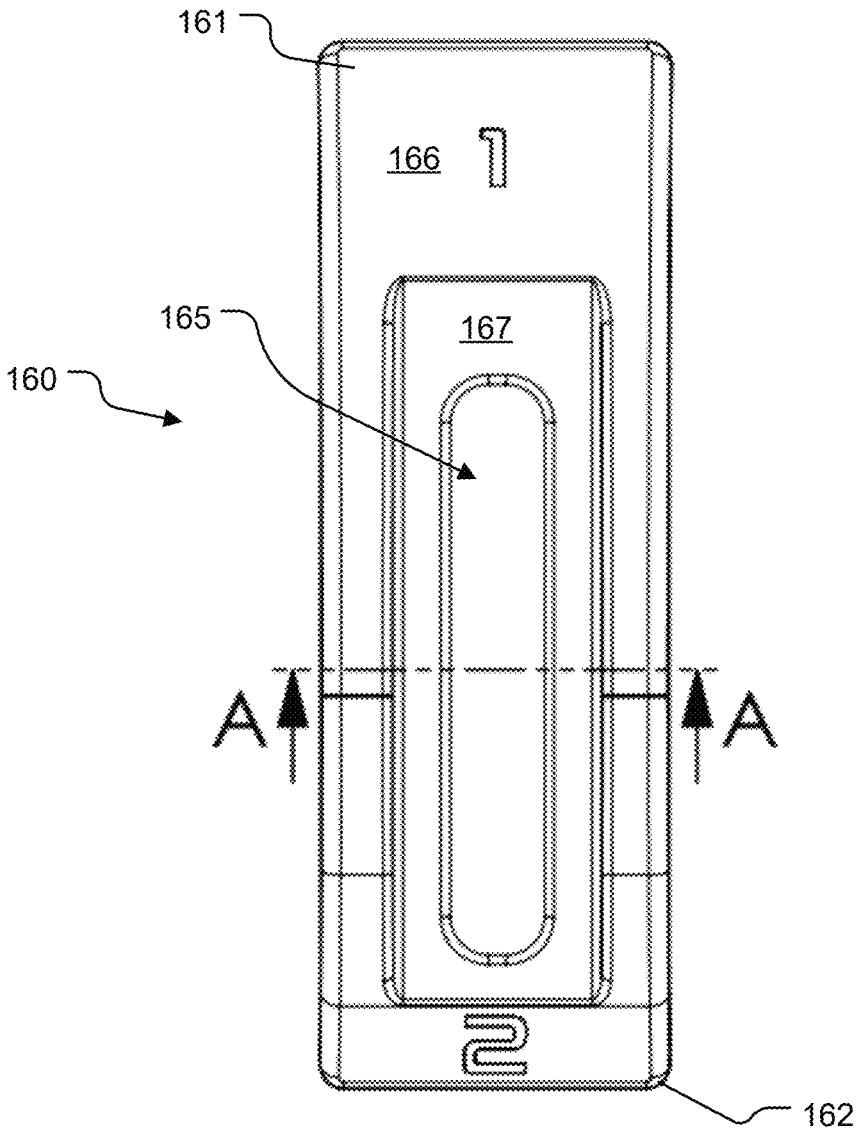
FIG. 6 is a top view of an embodiment of a tensioning mechanism.
Figure 7:
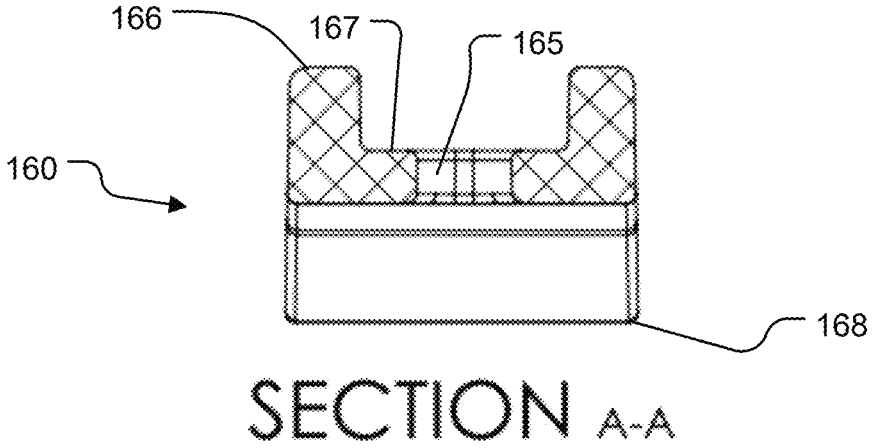
FIG. 7 is a cross-sectional view of an embodiment of a tensioning mechanism.

FIG. 3 shows the back side 122 of the back pad 120 of the holster 100. The back pad 120 is comprised of a flexible material to accommodate a various type of firearms 200 within the pocket 130 created between the front plate 110 and the front side 121 of the back pad 120. The back pad 120 may be fabric, rubber, foam, or the like that is able to flex to accommodate multiple models of a firearm 200. However, the back pad 120 in combination with the front plate 110 may not secure each and every model of firearm 200 within the pocket 130 as desired.

The holster 100 includes a first tensioning mechanism, or first plate, 160 and a second tensioning mechanism, or second plate, 170 connected to the back side 122 of the back pad 110. The first and second plates 160, 170 are connected to the back plate 120 and rigid front plate 110 via fasteners 180. The tension applied by the first and second plates 160, 170 to a firearm 200 positioned within the pocket 130 may be varied by the fasteners. In addition, compressible washers may be used in conjunction with the first and second plates 160, 170 and the fasteners 180 to vary the applied tension as would be appreciated by one of ordinary skill in the art having the benefit of this disclosure. Additionally, the first plate 160 and/or second plate 170 may be disconnected from the holster, rotated 180 degrees, and be reconnected to the rigid front plate 110 and back pad 120 to change the tension applied by the first and second plates 160, 170 as would be appreciated by one of ordinary skill in the art having the benefit of this disclosure.

FIGS. 4-7 show an embodiment of a first tensioning mechanism, or first plate, 160. The first plate 160 includes a first end 161, a second end 162, a first leg 163, a second leg 164, a first surface 166, a second surface 168, and an aperture 165 through the first plate 160. Fasteners 180 may be inserted through the aperture 165 to connect the first plate 160 to the rigid front plate 110 and back pad 120 of the holster 100. Compressible washers may also be used along with the fasteners 180 to change the tension applied by the first plate 160. The first plate 160 includes a recessed shoulder 167 adjacent to the aperture 165. As the geometry of the first leg 163 differs from the geometry of the second leg 164, the first plate 160 will apply a different tension to a firearm 200 positioned within the pocket 130 of the holster 100 depending on the orientation of the first plate 160.

Figure 8:
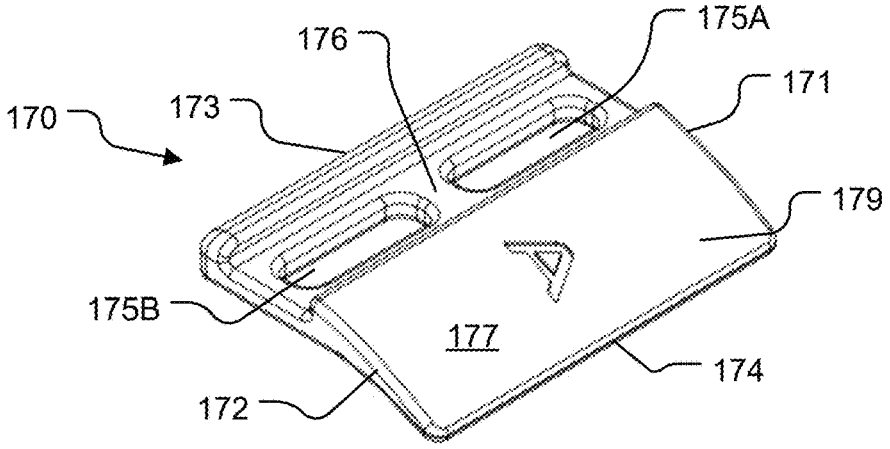
FIG. 8 is a perspective view of an embodiment of a tensioning mechanism.
Figure 9:
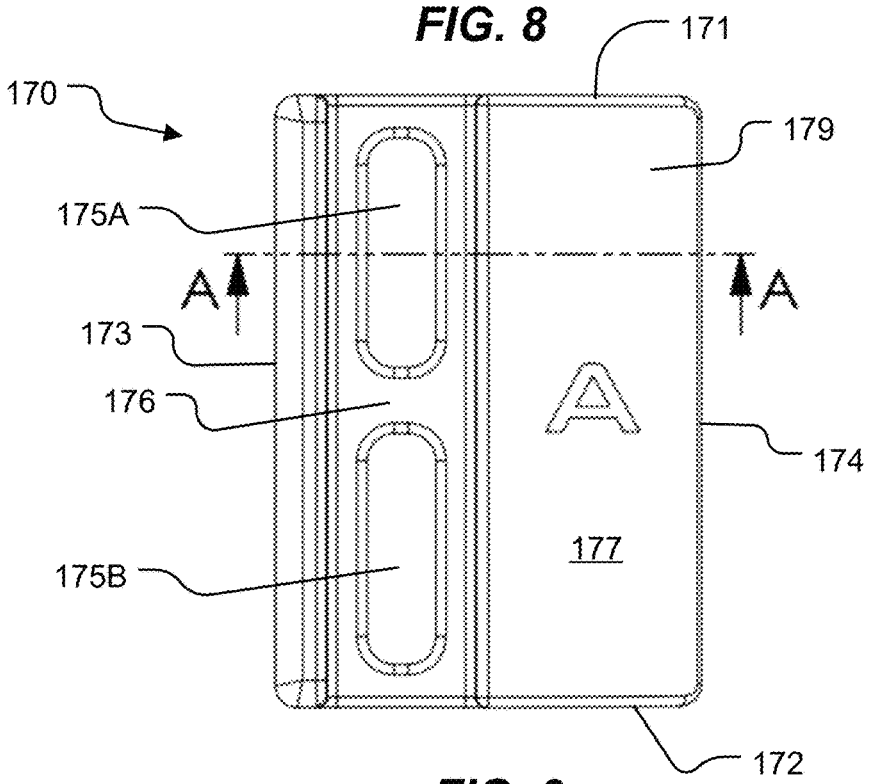
FIG. 9 is a top view of an embodiment of a tensioning mechanism.
Figure 10:
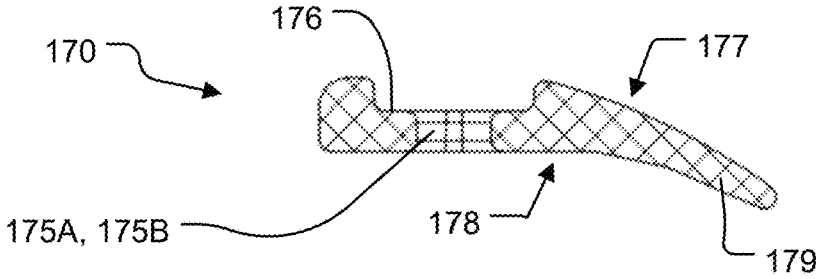
FIG. 10 is a cross-sectional view of an embodiment of a tensioning mechanism.

FIGS. 8-10 show an embodiment of a second tensioning mechanism, or second plate, 170. The second plate 170 includes a first end 171, a second end 172, a first edge 173, a second edge 174, a first surface 177, a second surface 178, and two apertures 175A, 175B through the second plate 170. Fasteners 180 may be inserted through the apertures 175A, 175B to connect the second plate 170 to the rigid front plate 110 and back pad 120 of the holster 100. Compressible washers may also be used along with the fasteners 180 to change the tension applied by the second plate 170. The second plate 170 includes a recessed shoulder 176 adjacent to the apertures 175A, 175B. The second plate 170 includes a leg 179. As the geometry of the leg 179 differs from the geometry of the first edge 173, the second plate 170 will apply a different tension to a firearm 200 positioned within the pocket 130 of the holster 100 depending on the orientation of the second plate 170.

Although various examples have been shown and described, the present disclosure is not so limited and will be understood to include all such modifications and variations as would be apparent to one skilled in the art.

What is claimed is:

1. A firearm holster comprising:

a back pad having a front side and a back side;

a rigid front plate connected to the front side of the back pad, wherein the front side of the back pad and the rigid front plate define a pocket configured to contact at least a portion of a firearm; and a first tensioning mechanism connected to the back side of the back pad, wherein the first tensioning mechanism comprises a first plate comprising a first leg that is configured to contact and deform the back side of the back pad and thereby vary tension applied to the firearm when within the pocket.

2. The firearm holster of claim 1, further comprising a second tensioning mechanism connected to the back side of the back pad, wherein the second tensioning mechanism is configured to vary tension applied to the firearm within the pocket.

3. The firearm holster of claim 1, wherein the first plate further comprises a first end, a second end, a second leg, a first surface, a second surface, and an aperture through the first plate.

4. The firearm holster of claim 3, wherein the first plate further comprises a recessed shoulder adjacent to the aperture.

5. The firearm holster of claim 4, wherein a geometry of the first leg differs from a geometry of the second leg.

6. The firearm holster of claim 5, wherein tension applied by the first plate may be varied by changing the orientation of the first plate.

7. The firearm holster of claim 6, wherein the second tensioning member is a second plate.

8. The firearm holster of claim 7, wherein the second plate further comprises a first end, a second end, a first edge, a second edge, a first surface, a second surface, and two apertures through the second plate.

9. The firearm holster of claim 8, wherein the second plate further comprises a recessed shoulder adjacent to the two apertures.

10. The firearm holster of claim 8, wherein the second plate further comprises a leg.

11. The firearm holster of claim 10, wherein tension applied by the second plate may be varied by changing the orientation of the first plate.

12. The firearm holster of claim 11, further comprising one or more fasteners that connect the first plate to the back pad and the rigid front plate and one or more fasteners that connect the second plate to the back pad and the rigid front plate.

13. The firearm holster of claim 12, further comprising one or more compressible washers positioned between the back pad and the first plate or the second plate.

14. A firearm holster comprising:

a back pad having a front side and a back side;

a rigid front plate connected to the front side of the back pad, wherein the front side of the back pad and the rigid front plate define a pocket;

a first tensioning mechanism connected to the back side of the back pad, wherein the first tensioning mechanism is configured to vary tension applied to a firearm within the pocket;

a second tensioning mechanism connected to the back side of the back pad, wherein the second tensioning mechanism is configured to vary tension applied to the firearm within the pocket;

wherein the first tensioning mechanism is a first plate; and wherein the first plate further comprises a first end, a second end, a first leg, a second leg, a first surface, a second surface, and an aperture through the first plate.

15. A firearm holster comprising:

a back pad having a front side and a back side;

a rigid front plate connected to the front side of the back pad, wherein the front side of the back pad and the rigid front plate define a pocket;

a first tensioning plate connected to the back side of the back pad, wherein the first tensioning plate is configured to vary tension applied to a firearm within the pocket and wherein the first tensioning plate further comprises a first end, a second end, a first leg, a second leg, a first surface, a second surface, and an aperture through the first plate.

16. The firearm holster of claim 15, further comprising a second tensioning plate connected to the back side of the back pad, wherein the second tensioning plate is configured to vary tension applied to the firearm within the pocket.

17. The firearm holster of claim 15, wherein the first tensioning plate further comprises a recessed shoulder adjacent to the aperture.

18. The firearm holster of claim 15, wherein a geometry of the first leg differs from a geometry of the second leg.

* * * * *